United States Patent [19]

Harris

[11] Patent Number: 4,896,476

[45] Date of Patent: Jan. 30, 1990

[54] APPARATUS FOR PACKAGING INSULATION MATERIAL

[75] Inventor: Ronald R. Harris, Granville, Ohio

[73] Assignee: Owens-Corning Fiberglas Corporation, Toledo, Ohio

[21] Appl. No.: 245,246

[22] Filed: Sep. 16, 1988

[51] Int. Cl.[4] ..... B65B 1/24; B65B 13/20; B30B 5/04

[52] U.S. Cl. ..... 53/118; 53/529; 100/126; 100/151

[58] Field of Search ..... 53/116, 118, 121, 430, 53/438, 439, 524, 529, 530; 100/76, 87, 90, 118, 126, 129, 130–136, 151, 154

[56] References Cited

U.S. PATENT DOCUMENTS

| | | | |
|---|---|---|---|
| 2,110,359 | 3/1938 | Droll et al. | 100/152 |
| 2,373,500 | 4/1945 | Pearce | 154/27 |
| 2,749,690 | 6/1956 | Bridges et al. | 53/524 |
| 2,890,496 | 6/1959 | Williams | 100/154 |
| 2,924,925 | 2/1960 | Cash | 53/524 |
| 3,401,896 | 9/1968 | Hullhorst | 53/438 X |
| 3,546,846 | 12/1970 | Sens | 53/438 X |
| 3,626,656 | 12/1971 | Langenscheidt | 53/524 X |
| 3,911,641 | 10/1975 | Miller et al. | 53/118 X |
| 3,964,235 | 6/1976 | Miller et al. | 53/118 |
| 3,987,752 | 10/1976 | Miller | 118/42 |
| 3,991,538 | 11/1976 | Finn et al. | 53/118 X |
| 4,163,353 | 8/1979 | Finn et al. | 53/430 |
| 4,164,177 | 8/1979 | Canfield | 100/40 |
| 4,550,556 | 11/1985 | Meiners | 56/341 |
| 4,602,471 | 7/1986 | Gray et al. | 53/430 |
| 4,653,397 | 3/1987 | Gray et al. | 100/76 |
| 4,711,067 | 12/1987 | Magni | 53/116 X |

*Primary Examiner*—Robert L. Spruill
*Assistant Examiner*—Beth Bianca
*Attorney, Agent, or Firm*—Patrick P. Pacella; James F. Porcello, Jr.

[57] ABSTRACT

The invention is an improved compression member for use in the packaging of insulation material. The compression member includes a plurality of curvilinear finger members defining a plurality of voids extending in the machine direction of the insulation material. The finger members and defined voids enhance the compression operation by encouraging an even release of compressed air across the width of the insulation pack and by guiding the insulation material into the packaging apparatus in a desired orientation.

4 Claims, 2 Drawing Sheets

APPARATUS FOR PACKAGING INSULATION MATERIAL

BACKGROUND OF THE INVENTION

This invention provides an apparatus for packaging flexible mineral fiber materials into a compressed package. Specifically, this invention pertains to an apparatus for use in packaging glass fiber insulation material into a tight compressed rolled package.

The manufacture of glass fiber insulation materials usually includes a final manufacturing process step in which the product is carried on a conveyor belt or its equivalent and is compressed to a fraction of its former volume. The compressed insulation product is delivered to a packaging machine which rolls the insulation material into a compressed roll-up or packages the insulation material in compressed batts. The compression of the glass fiber insulation material must be performed in such a manner that the integrity of the product is not diminished. If the material is overcompressed, the glass fiber will crush and the insulation value will be diminished. If the material is compressed, allowed to recover and compressed again during the roll-up step, the glass fiber integrity is weakened and the product is degraded. Therefore, it is important to gradually compress the insulation material immediately prior to the final packaging step. This objective has been addressed by U.S. Pat. No. 4,602,471 which discloses and claims the use of a compression chute positioned in an upstream position during the initiation of the roll-up of the pack.

New problems with maintaining the integrity of the insulation pack arose with the incorporation of compression chutes, such as the '471 invention into the packaging process. Rapid compression of the insulation pack within the compression chute created a large amount of compressed air. This resulted from the insulation material traveling through the compression chute at a rate exceeding the rate which the air can escape during the compression process. The tendency to increase manufacturing line speeds and the present-day capability of manufacturing wider and thicker insulation packs presented a new challenge to provide for the efficient escape of such compressed air as the insulation pack is processed through the compression chute. If the insulation pack travels through the compression chute at a rate sufficient to deny the escape of compressed air, the pack may explode or burst out backwards from the entrance of the compression area or the air may escape through the sides of the pack thereby damaging the pack integrity, pack edges and distorting the pack shape. U.S. Pat. No. 4,653,397 has addressed this problem by providing a top surface of a compression chute having apertures located throughout which provide for venting of the compressed air during the act of compressing the insulation pack.

However, it is still desirable to provide an apparatus which compresses the glass fiber of the insulation material straight down into the insulation pack. These prior compression chutes sometimes pull on the insulation material to shift the top of the pack backward as the pack is compressed thereby creating a tendency in the insulation material to pull and shift during compression. This phenomena obviously damages the overall integrity and insulation value of the end product. Another problem, during compression, which has yet to be addressed is the tendency of the glass fiber material to shift in a direction transverse to the machine direction, thus creating an uneven buildup of insulation material on one side of the pack. This is known as the parallelogram effect. Finally there is a demand for an apparatus which guides the compressed glass fibrous material into a desired orientation upon entering the packaging machine, such as a roll-up apparatus. If the material is not "squared" to the packaging machine the material will roll in an uneven manner creating an undesirable spiral buildup on the edge of the roll-up. This is commonly known as telescoping.

It is an object of this invention to provide an improved compression chute which allows compressed air to evenly escape from the pack during compression without damaging the integrity of the glass fiber.

It is another object of the invention to provide a compression chute which compresses the insulation pack straight down and discourages the glass fiber material from shifting during compression.

Yet another object of the present invention is to provide a compression chute which guides the insulation material into the packaging apparatus in a desired orientation to discourage telescoping of the insulation material during roll-up.

SUMMARY OF THE INVENTION

The present invention provides an apparatus which addresses these objectives by providing a compression member having a plurality of finger members in parallel with each other and extending in the machine direction of the insulation material. The finger members are spaced from one another, providing a superior ability to vent compressed air equally across the surface of the insulation material. The venting capacity of the present invention exceeds that of the other compression members heretofore used in the art. The finger members are curvilinear and provide a defined surface for engaging the insulation material which progressively approaches the surface of the conveyor member as the insulation material approaches the packaging apparatus.

As the insulation material is compressed by the finger members, the material tends to ridge slightly in the voids provided between the finger members. This ridging effect provides a self-guided orientation to the insulation material and assists in maintaining the insulation material in proper alignment as the material exits the compression apparatus and enters the roll-up apparatus. The preferred embodiment of the present invention also includes a brief flat press member located between the finger members and the roll-up member. The press member imparts a final compression to the insulation material, smoothing the material and eliminating the ridges immediately prior to roll-up. BRIEF DESCRIPTION OF THE DRAWINGS FIG. 1 is a schematic view in elevation of the compression member of the present invention.

DETAILED DESCRIPTION OF THE PREFERRED EMBODIMENT

Figure 1:
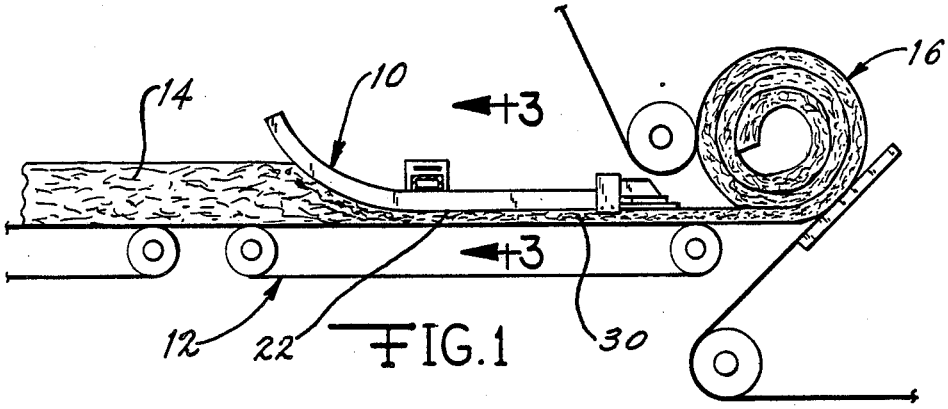
Figure 2:
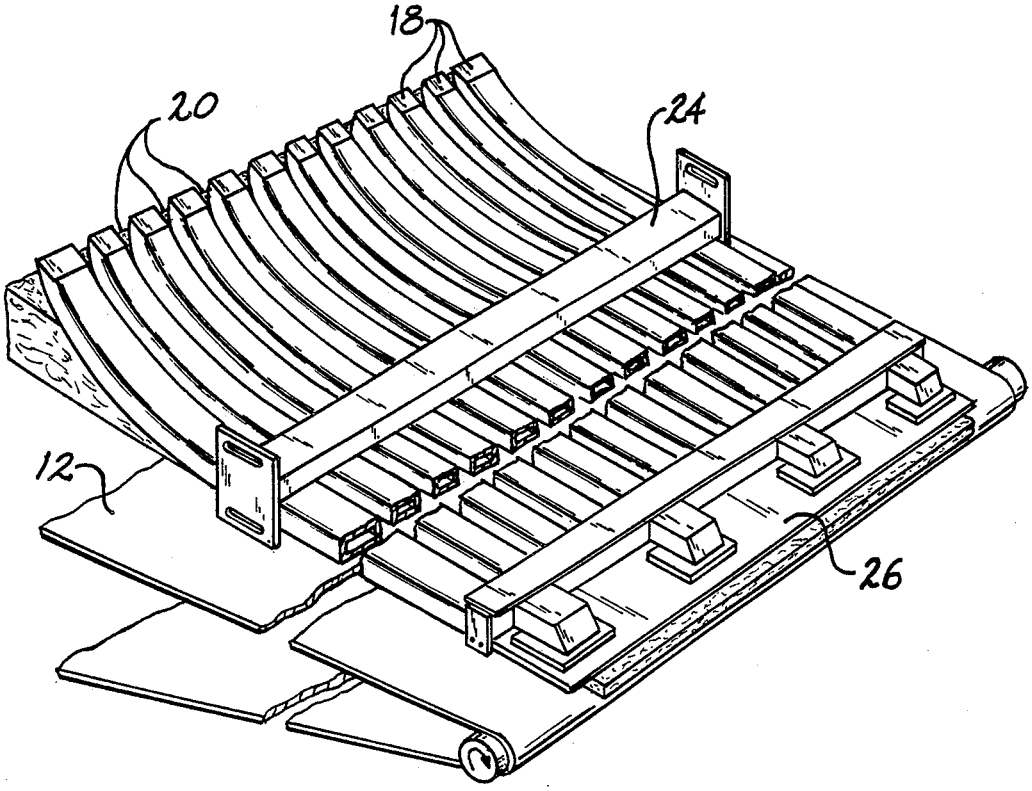
FIG. 2 is a perspective view, with cut away, of the compression member of the present invention.
Figure 3:
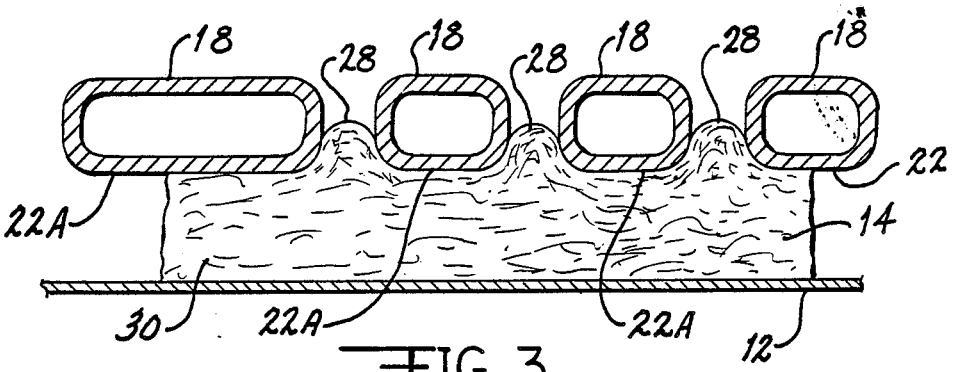
FIG. 3 is a partial sectional view taken along line 3—3 of FIG. 1.
Figure 4:
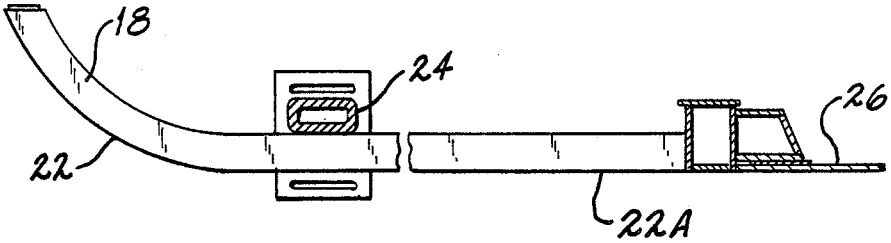
FIG. 4 is a side view of the compression member of the present invention.

With reference to the drawings, the compression member 10 of the present invention is oriented over an endless loop conveyor 12 which carries the insulation material 14 to a rolling apparatus 16. The compression member 10 is comprised of a plurality of finger members 18 which are equally spaced from one another to provide a plurality of voids 20 extending in the machine direction of the conveyor member 12. The finger members 18 are each ski-shaped, thereby defining a generally curvilinear surface 22 which progressively closes in the downstream direction toward the conveyor 12. The finger members 18 may be of any desired cross-section, however, preferably they are of a substantially rectangular cross-section and provide a generally planar surface 22A for engaging the insulation material 14. The planar surface 22A present a generally flat surface 22 of engagement with the insulation material 14 in the direction transverse to the machine direction of the conveyor 12 while maintaining the progressive curvilinear narrowing of the gap 30 between the finger members 18 and the conveyor 12 in the machine direction.

The finger members 18 with respect to the conveyor member 12 are held in position by a cross-support member 24 which extends the full width of the compression member 10. The cross-support member 24 prevents the finger members 18 from rising upward as a result of the compressive forces encountered between the compression member 10 and the insulation material 14.

A press member 26 defining a flat surface 28 is fixed to the curvilinear finger members 18 and is positioned between the finger members 18 and the rolling appartus 16. The press member 26 is designed to provide a final smoothing of the top surface of the insulation material 14 as the material is passed to the rolling apparatus.

The present invention operates to achieve the objectives for which it was designed in the following manner. As the insulation material 14 moves through the compression member 10 on the conveyor 12, it engages the planar surfaces 22A of the curvilinear finger members 18. The insulation material 14 is compressed downward into itself and compressed air escapes evenly from the insulation material 14 through the voids 20. The integrity of the insulation material 14 also causes the material 14 to compress in the voids 20, however small ridges 28 of insulation material 14 tend to expand upward into the voids 20. The ridges 28 guide the insulation material 14 as it progresses through the compression apparatus 10. The ridges 28 forming in between the fingers 18 also prevent the top of the insulation material 14 from moving transversely to one side or the other, thereby reducing the tendency of the insulation material 14 to parallelogram. Finally, the ridges 28 of the insulation material 14, as it compresses through the compression member 10, causes the insulation material 14 to orient and compress directly into the pack thereby forming a straight edge roll and reducing telescoping or spiral buildup on the edge of the pack.

The above description of the preferred embodiment is intended to be instructive and is not intended to be limiting upon the scope of the following claims.

I claim:

1. An apparatus for packaging compressible mineral fiber insulation material comprising, in combination: a conveyor for transporting such insulation material; means for rolling such insulation material into a packaged rollup; and, a compression member positioned over said conveyor immediately prior to said rolling means, said compression member including a plurality of finger members having generally planar surfaces of engaging such insulation material located in a fixed position relative to said conveyer, said fixed finger members being parallel to each other and defining voids therebetween extending in the machine direction of said conveyor, said fixed finger members defining a gap between said finger members and said conveyor, wherein such gap between said conveyor and said finger members progressively narrows as said conveyor approaches said rolling means and such mineral fiber insulation material is progressively compressed in such gap prior to rollup, such compression by said finger members maintaining such material in a predetermined longitudinal and transverse orientation; and, a flat press member positioned adjacent said finger members between said finger members and said rolling means, said press member providing a final smoothing compression to such insulation material as such insulation material is received from said finger members and enters said rolling means.

2. The packaging apparatus of claim 1 wherein each of said finger members is of a substantial rectangular cross section.

3. The packaging apparatus of claim 1, wherein such defined surface is generally curvilinear in the machine direction of said conveyor.

4. An apparatus for packaging compressible mineral fiber insulation material comprising, in combination: means for transporting such insulation material; means for packaging such insulation material; and means for compressing such insulation material prior to such material entering said packaging means, said compression means including a plurality of curvilinear finger members extending in the machine direction, said finger members defining a plurality of voids extending in the machine direction, wherein such insulation material is progressively compressed by said finger members to a first thickness and such insulation material progressively compresses in such voids to a second thickness, slightly greater than such first thickness, such difference in insulation material thickness providing for self-guided orientation; and a flat press member positioned adjacent said finger members between said finger members and said packaging means, said press member providing a final smoothing compression to such insulation material as such insulation material is received by said packaging means.

* * * * *